US007550071B1

(12) United States Patent
Dirk et al.

(10) Patent No.: US 7,550,071 B1
(45) Date of Patent: Jun. 23, 2009

(54) ELECTROCHEMICAL ASSEMBLY OF ORGANIC MOLECULES BY THE REDUCTION OF IODONIUM SALTS

(75) Inventors: Shawn M. Dirk, Albuquerque, NM (US); Stephen W. Howell, Albuquerque, NM (US); David R. Wheeler, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 818 days.

(21) Appl. No.: 11/065,894

(22) Filed: Feb. 25, 2005

(51) Int. Cl.

| | |
|---|---|
| ***C25D 7/12*** | (2006.01) |
| ***C25D 11/00*** | (2006.01) |
| ***C25B 3/00*** | (2006.01) |
| ***C25B 3/12*** | (2006.01) |

(52) U.S. Cl. ..... 205/457; 205/157; 205/317; 205/463

(58) Field of Classification Search ..... 205/317, 205/463, 118, 157, 457
See application file for complete search history.

(56) References Cited

OTHER PUBLICATIONS

Butin et al., "Specific Influence of the Electrode Material in the Electrochemical Reduction of Diphenyliodonium Salts", Izvestiya Akademii Nauk SSSR, Seriya Khimicheskaya (no month, 1979), vol. 6, pp. 1417-1418.*

Ignat'ev et al., "Electrochemical Initiation of Ion-Radical Reactions of Fluororganic Compounds. Reduction of Phenylperfluoroalkyliodonium", Elektrokhimiya (no month, 1992), vol. 28, No. 4, pp. 502-506.*

Bachofner et al., "Diaryliodonium Salts. V. The Electroreduction of Diphenyliodonium Salts", J. of the Amer. Chem. Soc., Aug. 20, 1958, p. 4269-4274.*

Beringer et al., "Electroreduction of Diphenyliodonium, Dibenziodolium, and 4,5-Phenanthryleneiodonium Ions", J. Org. Chem., vol. 37, No. 15 (no month, 1972), p. 2484-2489.*

Shawn M. Dirk, Directed Assembly of Organic Molecules by Selective Reduction Diazonium Salts, U.S. Appl. No. 10/984,569, filed Nov. 9, 2004.

Shawn M. Dirk, Potential Directed Assembly of Aryl Iodonium Salts onto Silicon Hydride Terminated Surfaces, to be published in the Journal of the American Chemical Society.

Jillian M. Buriak, Organometallic Chemistry on Silicon and Germanium Surfaces, Chemical Reviews, vol. 102, No. 5, May 2002, 1271-1308.

Michael P. Stewart, Direct Covalent Grafting of Conjugated Molecules onto Si, GaAs, and Pd Surfaces from Aryldiazonium Salts, J. Am. Chem. Soc., 2004, 126, 370-378.

Michael A. Carroll, New Synthesis of diaryliodonium sulfonates from arylboronic acids, Tetrahedron Letters, 41, 2000, 5393-5396.

(Continued)

*Primary Examiner*—Edna Wong
(74) *Attorney, Agent, or Firm*—Kevin W. Bieg

(57) ABSTRACT

Methods are described for the electrochemical assembly of organic molecules on silicon, or other conducting or semiconducting substrates, using iodonium salt precursors. Iodonium molecules do not assemble on conducting surfaces without a negative bias. Accordingly, the iodonium salts are preferred for patterning applications that rely on direct writing with negative bias. The stability of the iodonium molecule to acidic conditions allows them to be used with standard silicon processing. As a directed assembly process, the use of iodonium salts provides for small features while maintaining the ability to work on a surface and create structures on a wafer level. Therefore, the process is amenable for mass production. Furthermore, the assembled monolayer (or multilayer) is chemically robust, allowing for subsequent chemical manipulations and the introduction of various molecular functionalities for various chemical and biological applications.

8 Claims, 5 Drawing Sheets

OTHER PUBLICATIONS

J. V. Crivello, Diaryliodonium Salts. A New Class of Photoinitiators for Cationic Polymerization, Macromolecules, vol. 10, No. 6, Nov.-Dec. 1977.

F. M. Beringer, Diaryliodonium Salts. IX. The Synthesis of Substituted Diphenyliodonium Salts, J. Am. Chem. Soc., vol. 81, No. 2, 1959, 342-351.

David S. Ginger, The Evolution of Dip-Pen Nanolithography, Angew, Chem. Int. Ed. 2004, 43, 30-45.

Stephan Kramer, Scanning Probe Lithography Using Self-Assembled Monolayers, Chem. Rev., 2003, 103, 4367-4418.

Yan Li, Electrochemical AFM "Dip-Pen" Nanolithography, J. Am. Chem. Soc., 2001, 123, 2105-2106.

Patrick A. Hurley, Nanopatterning of Alkynes on Hydrogen-Terminated Silicon Surfaces by Scanning Probe-Induced Cathodic Electrografting, J. Am. Chem. Soc., 2003, 125, 11334-11339.

David Bullen, Parallel dip-pen nanolithography with arrays of individually addressable cantilevers, Applied Physics Letters, vol. 84, No. 5, Feb. 2, 2004, 789-791.

* cited by examiner

ELECTROCHEMICAL ASSEMBLY OF ORGANIC MOLECULES BY THE REDUCTION OF IODONIUM SALTS

STATEMENT OF GOVERNMENT INTEREST

This invention was made with Government support under contract no. DE-AC04-94AL85000 awarded by the U.S. Department of Energy to Sandia Corporation. The Government has certain rights in the invention.

CROSS-REFERENCE TO RELATED APPLICATION

This application is related to U.S. patent application Ser. No. 10/984,569, filed Nov. 9, 2004, which is incorporated herein by reference.

FIELD OF THE INVENTION

The present invention relates to lithography and, in particular, to the electrochemical assembly of organic molecules on a conducting or semiconducting surface by the reduction of iodonium salts.

BACKGROUND OF THE INVENTION

Silicon is ubiquitous in integrated circuits (ICs), microelectromechanical systems (MEMS), and sensing applications owing to the well-developed infrastructure for its manipulation into both electronic and structural elements. Typically, these applications are realized using standard lithographic procedures to generate transistors, lines, tiny gears, latches, sensors, etc. Current lithographic processes are often limited to a large extent by obtainable feature size and cost.

Furthermore, there is a growing interest in the use of organic molecules to control and tailor the interfacial characteristics of semiconductor surfaces to address emerging functional requirements for ICs, MEMS, and other micro- and nano-scale devices. In particular, self-assembled monolayers (SAMs) of organic molecules can provide a relatively ordered monolayer with a variety of chemical functional groups on a surface. The surface chemistry of organic molecules assembled on silicon surfaces has recently been reviewed. See Jillian M. Buriak, "Organometallic Chemistry on Silicon and Germanium Surfaces," *Chemical Reviews* 102(5), 1371 (2002), which is incorporated herein by reference.

The Si—C bond is both thermodynamically and kinetically stable due to the high bond strength and low polarity of the bond. However, upon exposure to air, single-crystal silicon becomes rapidly coated with a native oxide that must be removed chemically with fluoride, or thermally under UHV conditions, to provide a Si—C bond-forming surface. Preferably, the surface of silicon can be prepared to provide a precursor surface that is stable enough to be handled at atmospheric pressure in the presence of solvent vapors and other contaminants, yet reactive enough for subsequent monolayer assembly. In particular, a hydride-terminated silicon surface has been found to be relatively stable in air for short periods. Several wet chemical and UHV approaches to self-assemble organic molecules can be carried out on such hydride-terminated surfaces. Wet chemical approaches to Si—C bond formation include hydrosilylation involving a radical initiator, thermally induced hydrosilylation, photochemical hydrosilylation, and electrochemical grafting.

Recent work has shown that diazonium molecules self assemble via an electron transfer mechanism on many conducting and semiconducting surfaces, such as silicon and metals. See Stewart et al., "Direct Covalent Grafting of Conjugated Molecules onto Si, GaAs, and Pd Surfaces from Aryldiazonium Salts," *J. Am. Chem. Soc.* 126, 27 (2004), which is incorporated herein by reference. However, technologies are still required for the directed assembly of organic molecules onto silicon or other conductor or semiconductor surfaces. Such patterning is desirable to extend the utility of SAMs for specific applications, such as molecular electronic devices, molecular nanolithography, photovoltaic devices, and chemical and biological microsensors. In the related U.S. patent application Ser. No. 10/984,569 are described several methods for the directed assembly of organic molecules from the reaction of a diazonium salt precursor with a silicon surface. However, the diazonium assembly can be difficult to control, especially when using direct writing with negative bias.

SUMMARY OF THE INVENTION

The present invention provides methods for the electrochemical assembly of organic molecules on silicon, or other conducting or semiconducting substrates, using iodonium salt precursors. In particular, iodonium salts are preferable to diazonium salts for directed assembly, because the reduction potentials of similar salts are higher than the corresponding diazonium salts. Therefore, iodonium molecules do not assemble on conducting surfaces without a negative bias, even surfaces with a fairly low work function. Accordingly, the iodonium salts are preferred for patterning applications that relies on direct writing with negative bias.

Furthermore, iodonium will not self assemble on an oxide layer and exposure to oxide etchants will not remove the iodonium molecules once they are bound to a silicon or metallic surface. The stability of the iodonium molecule to acidic conditions allows them to be used with standard silicon processing. As a directed assembly process, the use of iodonium salts provides for small features while maintaining the ability to work on a semiconducting surface and create structures on a wafer level. Therefore, the process is amenable for mass production. Furthermore, the assembled monolayer (or multilayer) is chemically robust, allowing for subsequent chemical manipulations and the introduction of various molecular functionalities for various chemical and biological applications.

Therefore, a method for the electrochemical assembly of iodonium molecules on a surface of a conducting or semiconducting substrate comprises immersing the surface in a solution comprising an iodonium salt precursor and applying a negative bias voltage to the surface, thereby causing the iodonium molecules to self-assemble on the surface. The bias voltage can be more negative than −1 V, and preferably more negative than −2 V.

A method for the directed electrochemical assembly of iodonium molecules on a surface of a conducting or semiconducting substrate comprises providing a plurality of counter electrode opposed to and proximate the surface; immersing the counter electrodes in a solution comprising an iodonium salt precursor on the surface of the substrate; and applying a positive bias voltage to the counter electrodes to provide an image electron charge on a plurality of negatively biased surface regions opposite the plurality of positively biased counter electrodes, thereby directing self-assembly of iodonium molecules on the negatively biased surface regions.

Another method for the directed electrochemical assembly of iodonium molecules on a surface of a conducting or semiconducting substrate comprises providing an atomic force microscope comprising at least one tip in close proximity to the surface of the substrate; immersing the at least one tip in a solution comprising an iodonium salt precursor on the surface of the substrate; applying a positive voltage bias to the at least one tip; and rastering the at least one tip across the surface to provide a iodonium-patterned surface on the substrate.

Another method for the directed electrochemical assembly of iodonium molecules on a surface of a substrate comprises patterning the surface to provide a plurality of electron-rich and insulating regions; providing a counter electrode opposed to and proximate the patterned surface; immersing the counter electrode in a solution comprising a iodonium salt precursor on the patterned surface of the substrate; and applying a positive bias voltage to the counter electrode to provide an image electron charge on the plurality of electron-rich surface regions, thereby directing self-assembly of iodonium molecules on the electron-rich surface regions to provide an iodonium-patterned surface on the substrate.

The iodonium-patterned surface can be exposed to a solution comprising a chemical precursor molecule to react with the assembled iodonium molecules, thereby providing additional functionality to the iodonium-patterned surface. Alternatively, the iodonium-patterned surface can be further exposed to a selective etchant to remove the unpatterned portions of the surface.

The substrate preferably comprises a silicon substrate. However, other conducting and semiconducting substrates, such as metals and carbon, can also be used. The iodonium salt precursor preferably comprises an aryliodonium salt. The iodonium salt precursor can be functionalized with a hydroxyl, thiol, nitro, halogen, ester, amide, perfluoro or hydrocarbon group, for example.

BRIEF DESCRIPTION OF THE DRAWINGS

The accompanying drawings, which are incorporated in and form part of the specification, illustrate the present invention and, together with the description, describe the invention. In the drawings, like elements are referred to by like numbers.

DETAILED DESCRIPTION OF THE INVENTION

Figure 1:
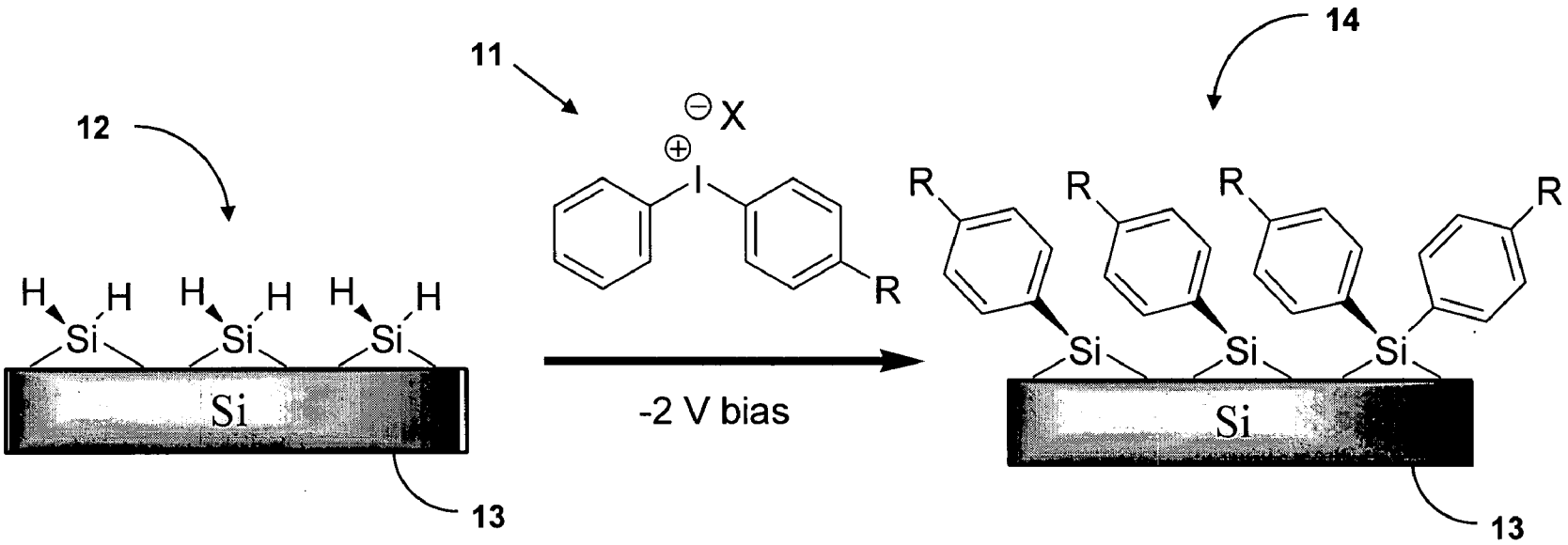
FIG. 1 shows an exemplary method for the electrochemical assembly of aryliodonium molecules on a silicon hydride terminated surface.

In FIG. 1 is shown the electro-reductive assembly of an aryliodonium salt 11 on a silicon hydride terminated surface 12. The mechanism of iodonium salt assembly is thought to be similar to the self-assembly method proposed by Stewart et al. for the attachment of diazonium salts to silicon hydride terminated surfaces. The silicon substrate 13 is negatively biased (e.g., at −2 V). In the first step of the reaction mechanism, an electron is transferred from the surface of the silicon to the iodonium salt. A hemolytic cleavage of the carbon-iodine bond results in an aryl radical and iodobenzene in solution. The radical can then be combined with the surface, forming a silicon-carbon bond. Once formed, the new covalent bond is very stable and the resulting monolayer 14 is chemically robust. In general, the iodonium salt can be reacted with surfaces comprising metals, carbon, or silicon via a reduction pathway to produce a metal-carbon, carbon-carbon, or silicon-carbon bond.

Many iodonium salts can be used with the electrochemical assembly methods of the present invention. Diaryliodonium salts are preferred precursors, because these salts are very stable and can be readily synthesized and purified by conventional techniques. The aryliodonium salts are easily prepared from either of two methods. The first method to prepare iodonium salts is carried out by the coupling reaction of phenyl boronic acids and aryl iodide diacetates. The second method employs a diacetoxyiodobenzene precursor and the desired aryl via an electrophilic aromatic substitution. See, e.g., M. A Carroll et al., "New Synthesis of diaryliodonium sulfonates from arylboronic acids," *Tetrahedron Letters* 41, 5393 (2000); and J. V. Crivello and J. H. W. Lam, "Diaryliodonium Salts: A new Class of Photoinitiators for Cationic Polymerization," *Macromolecules* 10, 1307 (1977), which are incorporated herein by reference. Furthermore, since the iodonium salt functional group is tolerant of many other functional groups (e.g., hydroxyl, nitro, thiol, halogen, ester, amide, perfluoro, hydrocarbon, etc.), the salts may be synthesized containing a host of other chemical functionality. These functionalities can, for example, be designed to control wetting behavior, adhesion, friction, and chemical interaction with the ambient environment above the surface.

Iodonium salts are preferable to diazonium salts for directed assembly, because the reduction potentials of similar salts are on the order of 1 V higher than the corresponding diazonium salts, as determined by cyclic voltammetry. Therefore, iodonium molecules do not assemble on conducting surfaces without a negative bias, even surfaces with a fairly low work function. Therefore, the iodonium salts are preferred for patterning applications that rely on direct writing with negative bias. Localized application of a voltage potential to an electrically conducting bulk substrate or to a substrate that contains an electrically conducting pattern only affects those iodonium precursor molecules that are very close to the charged surface. The difference between the generation of solution radicals, and the concomitant generation of surface silicon radicals, between negatively biased and unbiased surface regions (or patterned and unpatterned surface conducting regions) enables selective assembly of iodonium monolayers on surfaces that are locally biased. Therefore, the directed electrochemical assembly of iodonium monolayer on specific electrodes can be achieved.

Figure 2:
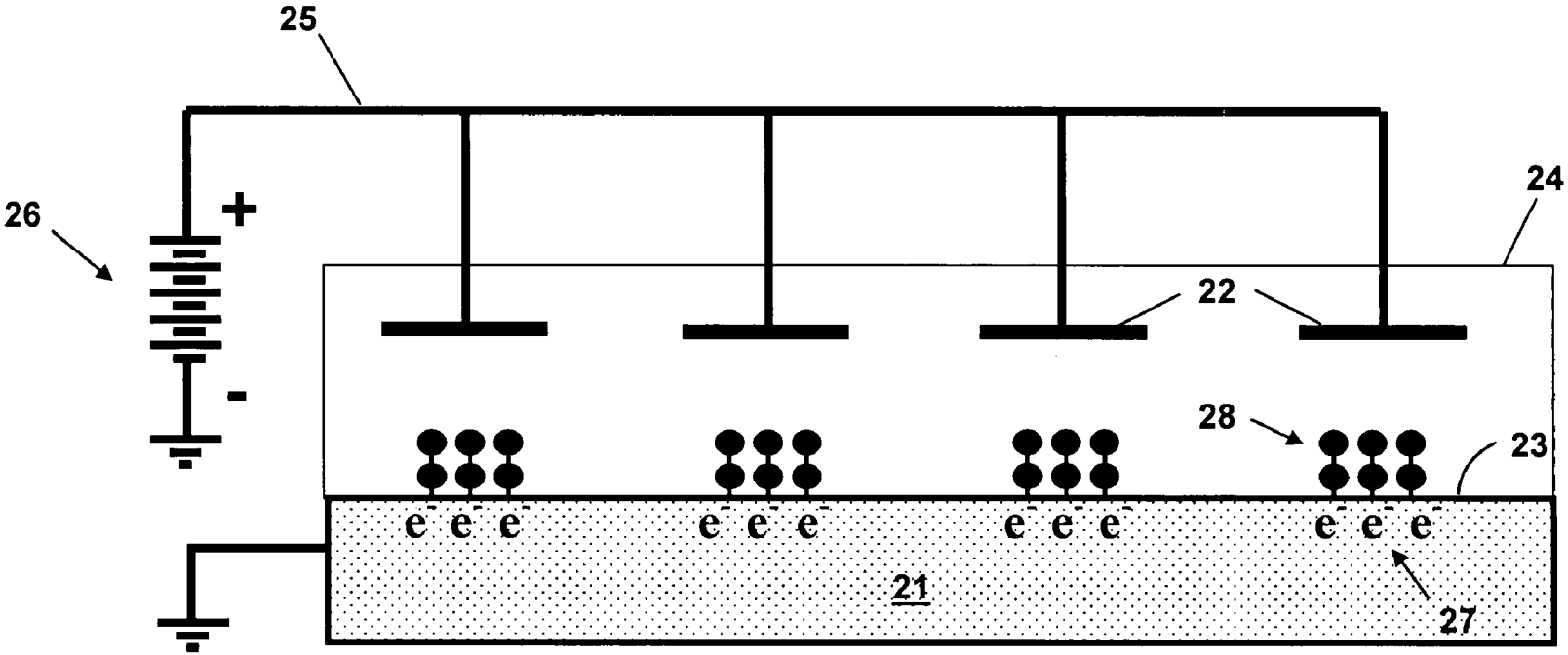
FIG. 2 shows a schematic illustration of an apparatus and method for the directed electrochemical assembly of a patterned iodonium monolayer on an electrically conducting or semiconducting substrate.

In FIG. 2 is shown an apparatus for the directed electrochemical assembly of a patterned iodonium monolayer on a substrate. A plurality of counter electrodes 22 are provided that are opposed to and proximate the surface 23 of the substrate 21. The substrate 21 is preferably a conducting or semiconducting substrate (e.g., n-type silicon, metal, or carbon), although a highly conductive surface is not required. The surface 23 can be at least partially hydride-passivated to preclude the formation of an oxide layer on the surface. For example, the substrate 21 can comprise a silicon substrate that is pretreated with a dilute hydrofluoric acid wash to remove any native oxide and ensure a hydride-passivated surface. The counter electrodes 22 are immersed in a solution 24, comprising the iodonium salt precursors, on the surface 23 of the substrate 21. The solution can be an acidic or a mildly basic solution. Assembly is enhanced with the addition of an electrolyte, such as $Bu_4N^+BF_4^-$. For example, the solution can comprise 1.0 mmol of iodonium salt dissolved in a 0.1 mol solution of tetrabutylammonium tetrafluoroborate in acetonitrile. A positive bias voltage (e.g., +2 V) is applied to the plurality of counter electrodes 22 via conducting leads 25 attached to voltage source 26. The applied potential causes an image electron charge to accumulate in those negatively biased surface regions 27 of the substrate 21 opposite the positively biased counter electrodes 22. The negative surface bias reduces the iodonium salts and subsequently covalently bonds the generated radicals to the silicon hydride surface where the bias has been applied. The difference in charge density between the biased regions and the unbiased regions will cause the iodonium molecules 28 to selectively assemble on the cathodic surface of the negatively biased surface regions 27 proximate the counter electrodes 22. In particular, a densely packed monolayer can be obtained by monitoring the electrochemical charge and by proper choice of the grafting potential. Those skilled in the art will realize that iodonium salts comprising a variety of substituent groups can be electrochemically assembled by this method. Furthermore, the technique can be applied to a variety of conducting substrates, including conductors and doped semiconductors.

Recently, instruments developed for scanning probe microscopy (SPM) have been modified to generate patterns on surfaces from microscopic to atomic scales. In particular, scanning probe lithography (SPL) is simple and enables precise control of the pattern structure and location. This process may be achieved with an atomic force microscope (AFM) by holding the AFM tip at a voltage potential in a solution or using an ink containing the desired material and directing assembly onto a localized surface. This process, known as dip-pen nanolithography (DPN) is a relatively new scanning-probe based direct-write tool that can generate surface-patterned chemical functionality on a sub-100 nm length-scale. See, e.g., D. S. Ginger et al., "The Evolution of Dip-Pen Nanolithography," *Angew. Chem. Int. Ed.* 43, 30 (2004); and S. Kramer et al., "Scanning Probe Lithography Using Self-Assembled Monolayers," *Chem. Rev.* 103, 4367 (2003); which are incorporated herein by reference.

Figure 3:
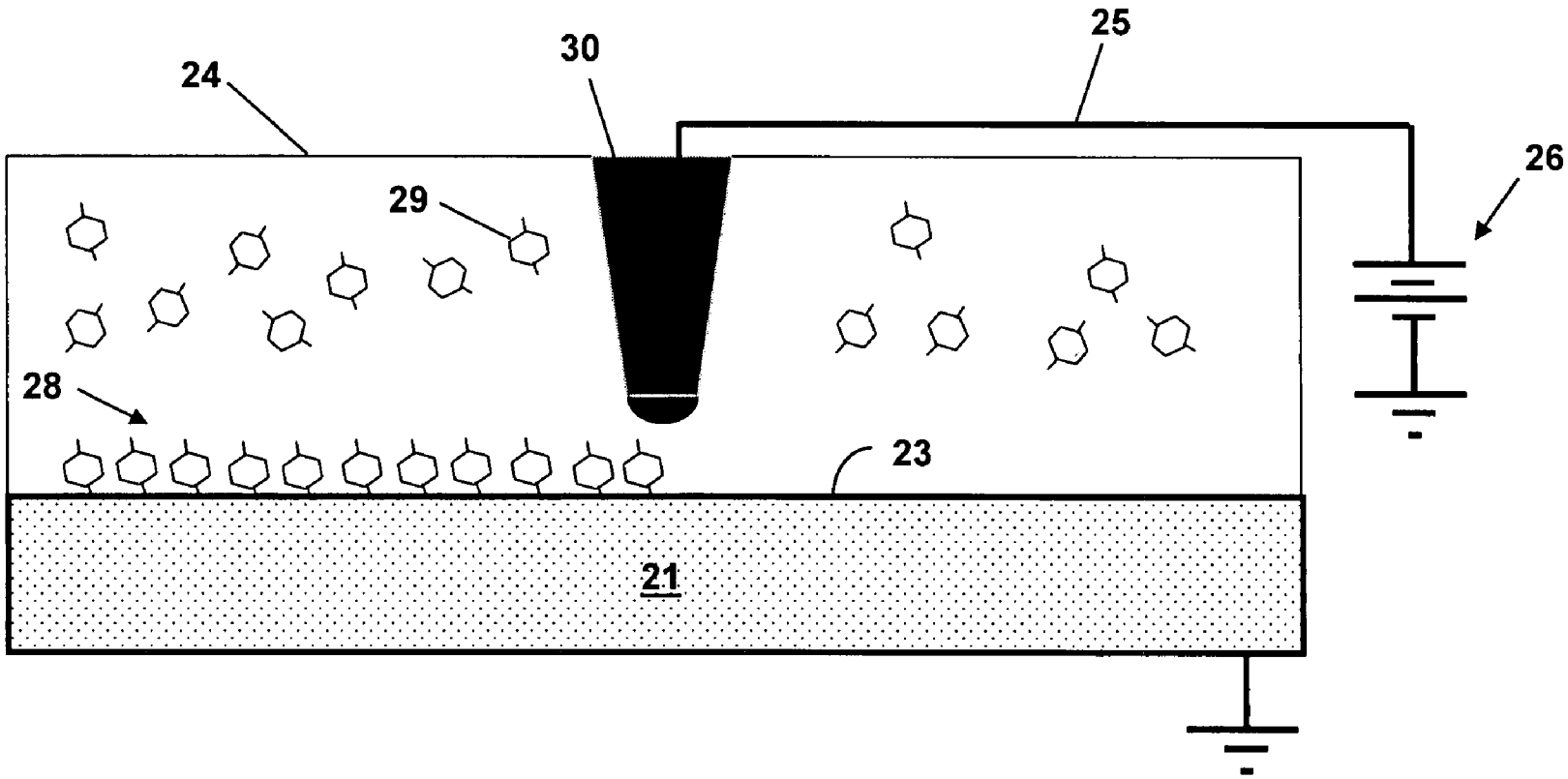
FIG. 3 shows a schematic illustration of a directed assembly of a patterned iodonium monolayer onto a surface using electrochemical dip-pen nanolithography.

DPN can also be used for the electrically driven assembly of patterned monolayers. See Yan Li et al., "Electrochemical AFM "Dip-Pen" Nanolithography," *J. Am. Chem. Soc.* 123, 2105 (2001); and P. T. Hurley et al., "Nanopatterning of Alkynes on Hydrogen-Terminated Silicon Surfaces by Scanning Probe-induced Cathodic Electrografting," *J. Am. Chem. Soc.* 125, 11334 (2003); which are incorporated herein by reference. In FIG. 3 is shown a schematic illustration of an electrochemical-DPN (E-DPN) method that can also be used to pattern iodonium molecules onto a substrate surface. A conducting lead 25 from a voltage source 26 is electrically connected to an AFM tip 30 and the conducting substrate 21. Preferably, the conducting substrate 21 comprises n-type silicon, although a high conductivity is not required. The surface 23 is preferably hydride-passivated. The AFM tip 30 can be placed in a liquid solution 24 on the substrate 21. The solution 24 comprises iodonium salt precursor molecules 29. The solution 24 can be an acidic or a mildly basic solution comprising an anhydrous solvent. The AFM tip 30 is brought into close proximity to the surface 23 of the conducting substrate 21. A positive voltage bias is applied to the AFM tip 30, relative to the substrate 21, via the conducting lead 25. By applying an appropriate bias to the AFM tip 31, an electrochemical circuit is established between the tip 30 and the substrate 21, thereby enabling a localized reduction of the precursor iodonium salt 29 in solution 24. Therefore, the applied voltage causes an iodonium monolayer 28 to electrochemically assemble on the cathodic surface of the substrate. The AFM tip 30 thereby directs the electrochemical grafting of the iodonium molecules 29 to the surface 23 only where it is desired. The AFM tip 30 can be rastered across the surface 23 to provide the patterned iodonium layer 28 on the substrate 21.

The writing speed of a single-pen DPN is inherently low, due to its serial methodology. The recent development of parallel, direct-write cantilevered arrays of pens will increase the throughput and patterned area. These multi-pen arrays can be fabricated using MEMS technologies. Furthermore, each cantilever of the multi-pen array can be individually actuated and controlled. Therefore, different patterns with different inks can be generated while traveling the same overall path. See D. Bullen et al., "Parallel dip-pen nanolithography with arrays of individually addressable cantilevers," *Appl. Phys. Lett.* 84(5), 789 (2004), which is incorporated herein by reference.

Figure 4:
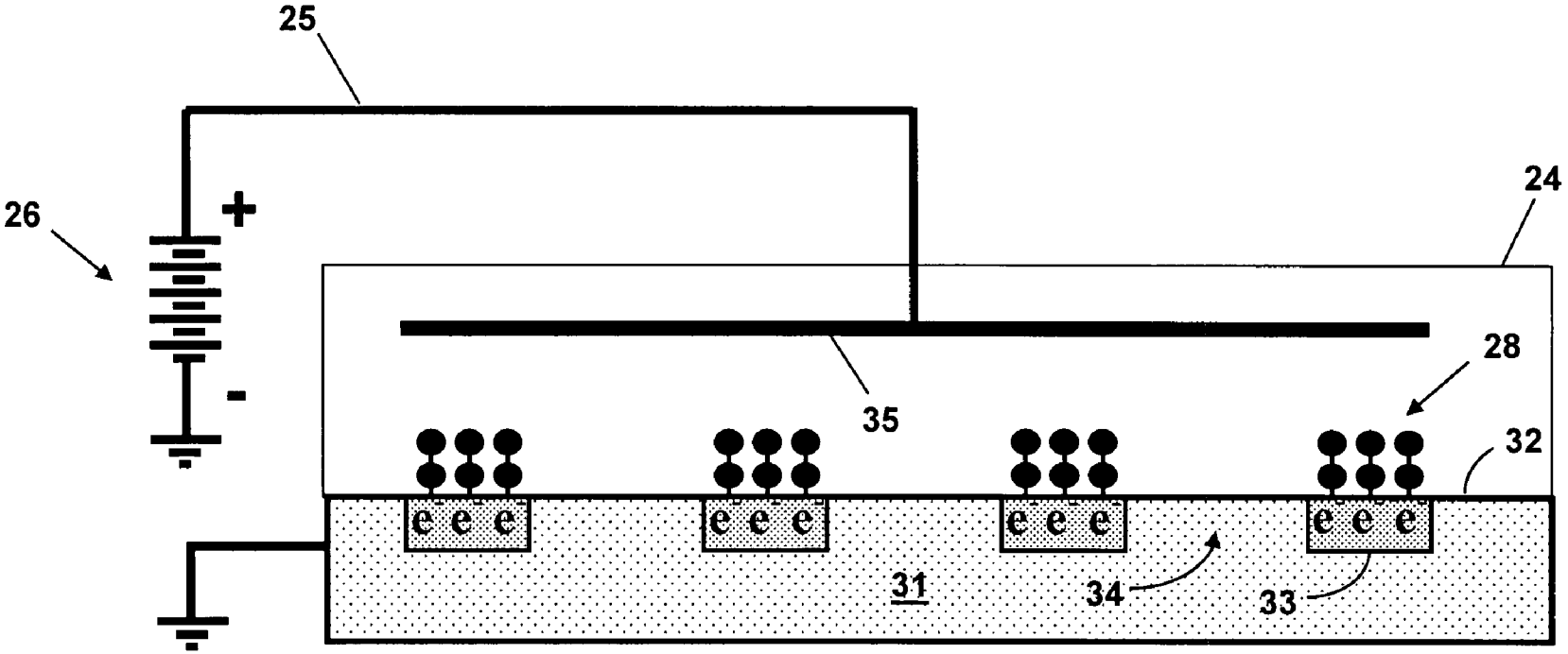
FIG. 4 shows a schematic illustration of an apparatus and method for the directed electrochemical assembly of an iodonium monolayer on a patterned substrate.

Rather than direct writing with a plurality of counter electrode, a patterned substrate can be used to direct the electrochemical assembly of the iodonium molecules using a single electrode. In FIG. 4 is shown an apparatus and method for the directed electrochemical assembly of iodonium on a patterned substrate. The substrate 13 is patterned to provide a patterned surface 32 comprising a plurality of electron-rich surface regions 33 and insulating regions 34. The electron-rich regions 33 can be patterned by ion implantation, selective deposition of conductive material, or other patterning processes on a conducting or semiconducting substrate. For example, the substrate 31 can be intrinsic silicon. The silicon can be ion-implanted with electron-donating dopants (e.g., P, As, Sb) to make the intrinsic material more electron conducting in these n-doped regions 33. Preferably, the electron-rich regions 33 are heavily doped n-type (i.e., n+). Iodonium molecules can then be directed to electrochemically assemble on the doped regions of the surface. Alternatively, insulating regions 34 can be patterned on a conducting or semiconducting substrate. For example, a pattern can be generated in a surface oxide layer of a silicon substrate using standard lithographic and oxide etching techniques, as described in the related U.S. patent application Ser. No. 10/984,569. Iodonium molecules can then be directed to electrochemically assemble on the etched silicon regions of the surface.

A counter electrode 35 is provided opposed to and proximate the patterned surface 32. The patterned surface 32 comprises a plurality of electron-rich regions 33 and insulating regions 34. The electron-rich regions 33 can be at least partially hydride-passivated to preclude the formation of a native oxide layer on the surface. The counter electrode 35 is immersed in a solution 24, comprising the iodonium salt precursors, on the surface 33 of the substrate 31. The solution can be an acidic or a mildly basic solution. Assembly is enhanced with the addition of an electrolyte. A positive bias voltage is applied to the counter electrode 35 via conducting leads 25 attached to voltage source 26. The applied potential causes an image electron charge to accumulate preferentially in the electron-rich surface regions 33, thereby generating an uneven potential on the patterned surface 32 of the substrate 31. The difference in surface charge density between the electron-rich regions 33 and the insulating regions 34 will cause the iodonium molecules 28 to selectively assemble on the cathodic surface of the electron-rich regions 43, providing an iodonium-patterned surface.

The patterned iodonium monolayer can act as a primer for subsequent chemistries. Several chemistries exist that will allow for the attachment of different functionalites to the patterned iodonium layer. The iodonium molecules can be functionalized by placing the substrate, comprising the patterned iodonium monolayer, in a second solution comprising second chemical precursor molecules. The second precursor molecules will not bond to the unpatterned portions of the substrate. Likewise, the second precursor molecules will not displace the already assembled iodonium molecules. For example, patterns of biomolecules (such as antibodies, DNA, or proteins) can be formed on the patterned iodonium monolayer. Standard chemistry can be used to link the biomolecules to the patterned iodonium. Additional functionalization can be achieved by placing the patterned substrate sequentially in additional solutions containing additional precursor molecules. This method thereby provides spatially defined regions of iodonium handles to drive the patterned deposition of functionalized molecules.

Figure 5:
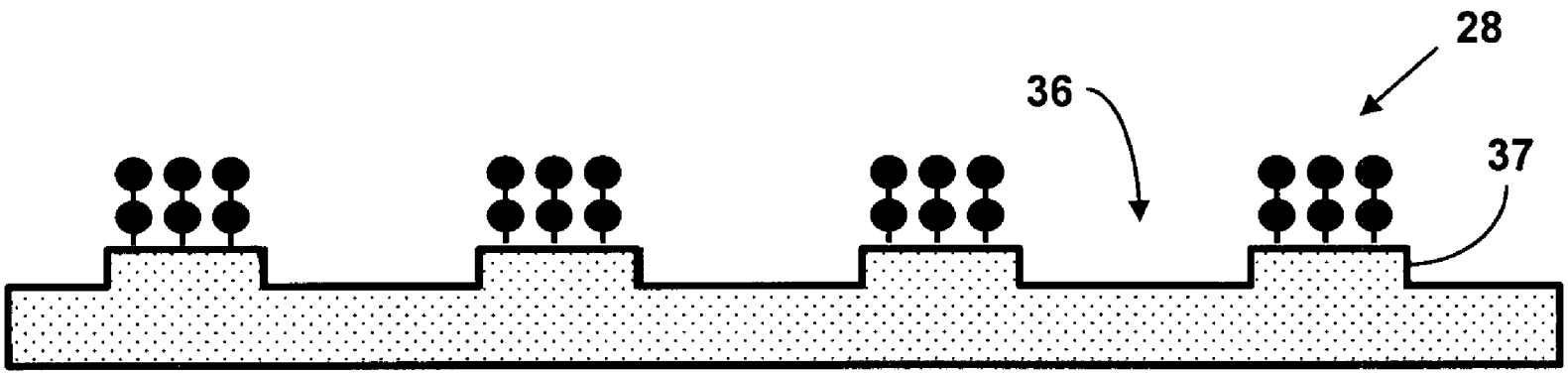
FIG. 5 shows a schematic illustration of the use of an iodonium-patterned surface as an etch mask to create a trench in the unpatterned regions of the substrate.

Alternatively, the iodonium layer can passivate the patterned regions, providing an etch mask for removal of the exposed unpatterned portions of the substrate. The assembled iodonium molecules will be stable to most chemical etchants. Therefore, as shown in FIG. 5, an iodonium-patterned surface 28 can be exposed to an etchant to create a trench 36 in the unpatterned regions and leave a raised pattern 37 underlying the passivated, iodonium-patterned regions. For example, an iodonium-patterned silicon surface can be exposed to KOH to create a trench in the exposed silicon regions. The raised iodonium pattern can be further functionalized, as described above.

The present invention has been described as the electrochemical assembly of organic molecules by the reduction of iodonium salts on a conducting or semiconducting surface. It will be understood that the above description is merely illustrative of the applications of the principles of the present invention, the scope of which is to be determined by the claims viewed in light of the specification. Other variants and modifications of the invention will be apparent to those of skill in the art.

We claim:

1. A method for the electrochemical assembly of iodonium molecules on a surface of a silicon substrate, comprising:

immersing the surface in a solution comprising an iodonium salt precursor; and applying a negative bias voltage to the surface, thereby causing iodonium molecules to self-assemble on the surface from the solution comprising the iodonium salt precursor.

2. The method of claim 1, wherein the iodonium salt precursor comprises an aryliodonium salt.

3. The method of claim 1, wherein the iodonium salt precursor comprises a functional group selected from the group consisting of hydroxyl, nitro, thiol, halogen, ester, amide, perfluoro and hydrocarbon.

4. A method for the electrochemical assembly of iodonium molecules on a surface of a conducting or semiconducting substrate, comprising:

immersing the surface in a solution comprising an iodonium salt precursor;

applying a negative bias voltage to the surface, thereby causing iodonium molecules to self-assemble on the surface from the solution comprising the iodonium salt precursor; and exposing the assembled iodonium surface to a solution comprising a chemical precursor molecule to react with the assembled iodonium molecules, thereby providing additional functionality to the iodonium surface.

5. The method of claim 4, wherein the iodonium salt precursor comprises an aryliodonium salt.

6. The method of claim 4, wherein the iodonium salt precursor comprises a functional group selected from the group consisting of hydroxyl, nitro, thiol, halogen, ester, amide, perfluoro and hydrocarbon.

7. The method of claim 4, wherein the semiconducting surface comprises silicon.

8. The method of claim 4, wherein the conducting substrate comprises a metal or carbon.

* * * * *